United States Patent [19]

Hendrickson

[11] 4,202,635

[45] May 13, 1980

[54] PORTABLE DEVICE FOR MIXING TWO MATERIALS

[76] Inventor: Carl E. Hendrickson, P.O. Box 81, Sheridan, Wyo. 82801

[21] Appl. No.: 856,968

[22] Filed: Dec. 2, 1977

[51] Int. Cl.[2] ..... B01F 15/04

[52] U.S. Cl. ..... 366/162; 366/338; 366/339

[58] Field of Search ..... 366/160, 161, 162, 176, 366/190, 336, 337, 338, 339, 3, 11, 10

[56] References Cited

U.S. PATENT DOCUMENTS

| | | | |
|---|---|---|---|
| 1,139,610 | 5/1915 | Wegner | 366/339 |
| 1,626,487 | 4/1927 | Warren | 366/339 |
| 2,601,018 | 6/1952 | Heyl | 366/339 |
| 2,833,840 | 5/1958 | Longwell | 366/339 |
| 3,203,371 | 8/1965 | Mosey | 366/336 |
| 3,232,585 | 2/1966 | Garbarino | 366/160 |
| 3,582,045 | 6/1971 | Leybourne | 366/339 |
| 3,949,904 | 4/1976 | Hendrickson | 366/160 |
| 3,985,165 | 10/1976 | Tamir | 366/339 |
| 4,074,363 | 2/1978 | Croft | 366/339 |

FOREIGN PATENT DOCUMENTS

| | | | |
|---|---|---|---|
| 2317010 | 10/1974 | Fed. Rep. of Germany | 366/339 |

*Primary Examiner*—Robert W. Jenkins

*Attorney, Agent, or Firm*—Hill, Van Santen, Steadman, Chiara & Simpson

[57] ABSTRACT

A portable device for mixing two materials for discharge from a nozzle characterized by a separate container for each of the two materials with each container having means to discharge the contents of the container under pressure through a discharge tube, a mixing tube of flexible material having a discharge end and an inlet end with a mixing element received in the mixing tube and extending between the ends, a nozzle attached to the discharge end, and coupling means attached to the inlet end for connecting the discharge tubes of the containers thereto. The mixing element may take the form of a helically twisted strip member which may have projections extending from opposite edges thereof or may have one or more rows of perforation to form helical extending element spaced apart by a row of perforations and interconnected by bars extending between adjacent perforations. In another embodiment of the invention, the mixing member is a helical coil of wire with the coil either having a constant outer diameter or a varying outer diameter. In each case, the coaction of the mixing element plus the bending or curving of the flexible mixing tube, which bending or curving occurs during positioning of the nozzle coact to ensure a thorough mixing of the separately introduced materials prior to discharge from the nozzle.

10 Claims, 14 Drawing Figures

PORTABLE DEVICE FOR MIXING TWO MATERIALS

BACKGROUND OF THE INVENTION

1. Field of the Invention

The present invention is directed to a portable mixing device for mixing two materials and for dispensing the mixed materials under pressure through a nozzle.

2. Prior Art

In my U.S. Pat. No. 3,949,904, a portable dispensing device for use as an epoxy gun which mixes two constituents or materials of desired proportion and dispenses the mixed material under pressure through a nozzle was disclosed. In the device of the above mentioned patent, the mixing was accomplished by the rotational movement of a mixing element in a mixing chamber and the device used a special arrangement of the parts to improve the sealing of the drive shaft for the mixing element. While the mixing element of this device provided a good mixing of the various materials such as the epoxy constituents of the epoxy resin, and the device had an improved seal around the drive shaft for the mixing element, problems of sealing the drive shaft and cleaning the device after use were still present.

SUMMARY OF THE INVENTION

The present invention is directed to a portable dispensing device such as an epoxy gun which mixes two constituents or materials in the desired proportion and dispenses the mixed materials under pressure through a nozzle. The present device does not involve any moving parts for the mixing element and thus does not require special seals or considerations for seals around drive shafts for the moving parts.

To accomplish these goals, the portable device for mixing two materials in the desired proportion and dispensing the materials under pressure from the nozzle comprises a separate container for each of the two materials; each of said containers having means for discharging the contents of the container under pressure from a discharge tube; a mixing tube of a flexible material having a discharge end and an inlet end with a helical mixing element received in the mixing tube and extending between said ends; a nozzle attached to the discharge end of the mixing tube; and coupling means attached to the inlet end of the mixing tube for connecting the discharge tube of the containers thereto so that a coaction of the helical mixing element and any curvature in the flexible mixing tube provides a thorough mixing of the two materials as they pass along the tube prior to discharge from the nozzle.

In one embodiment of the invention, the helical mixing element is a helically twisted strip member. The strip member may have projections extending from opposite edges thereof and the twisting of the strip member causes the projections to extend outward from the axis of the member at different angles with two adjacent projections forming an angle less than 180°. In another modification of the strip member, the strip member has at least one row of perforations extending therealong to define at least two helically extending elements spaced apart by a row of perforations and interconnected by bars extending between adjacent perforations. In the modification with the rows of perforations, the strip may have a single row of perforations or more than one row of perforations.

In another embodiment of the invention, the helical mixing element is a helical coil of wire. The helical coil is loosely received in the mixing tube so that the material can flow between the wire of the helical coil and the interior wall of the mixing tube as well as through the helical coil of wire. The helical coil wire can have a constant outer diameter or may have a constantly changing outer diameter. Of the embodiments having a changing outer diameter, the adjacent turns of the helical coil may have a different diameter so that a small diameter turn is disposed between two large diameter turns. In another modification, the changing diameter of the helical coil may be gradual so that the diameter of the helical coil gradually decreases from a maximum to a minimum diameter and then gradually increases back to the maximum diameter. Another modification has a change of the diameter between the maximum diameter and the minimum diameter being gradual and the change between the minimum and maximum being an abrupt change so that the helical coil has a profile of gradually decreasing to a minimum diameter and then abruptly increasing to a maximum diameter followed by a gradual decreasing to a minimum diameter.

DESCRIPTION OF THE PREFERRED EMBODIMENTS

Figure 1:
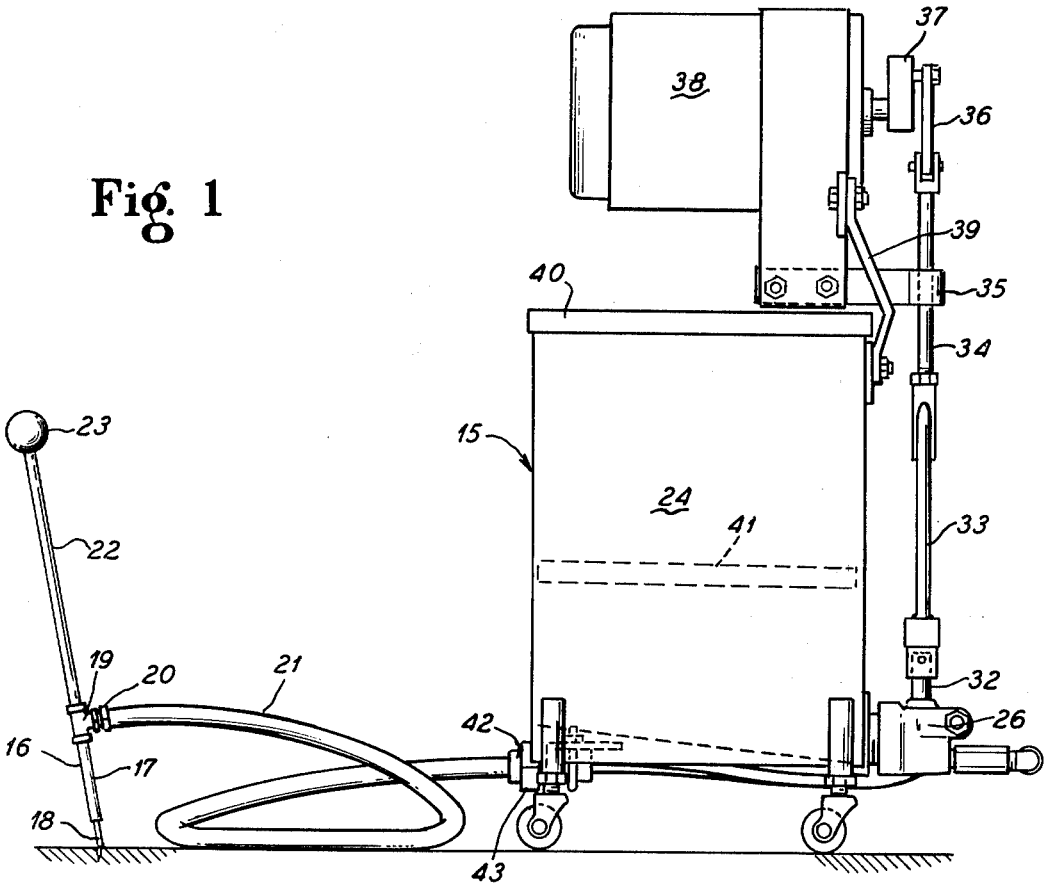
FIG. 1 is a view of the portable device in accordance with the present invention.

The principles of the present invention are particularly useful when incorporated in a portable device generally indicated at 15 in FIG. 1. The device 15 mixes two materials in a desired proportion and dispenses the mixed materials under pressure through a nozzle 16. As best illustrated, the nozzle 16 has a tubular portion 17 terminating in a needle-like nose 18, which may either be tapered or a thin needle. The tubular portion 17 is attached to a tee 19, which is connected by a hose coupling 20 to the discharge end of a flexible mixing tube 21. The other end of the tee 19 receives a member 22 terminating in a ball grip 23, which enables the operator to position the nozzle 16.

Figure 2:
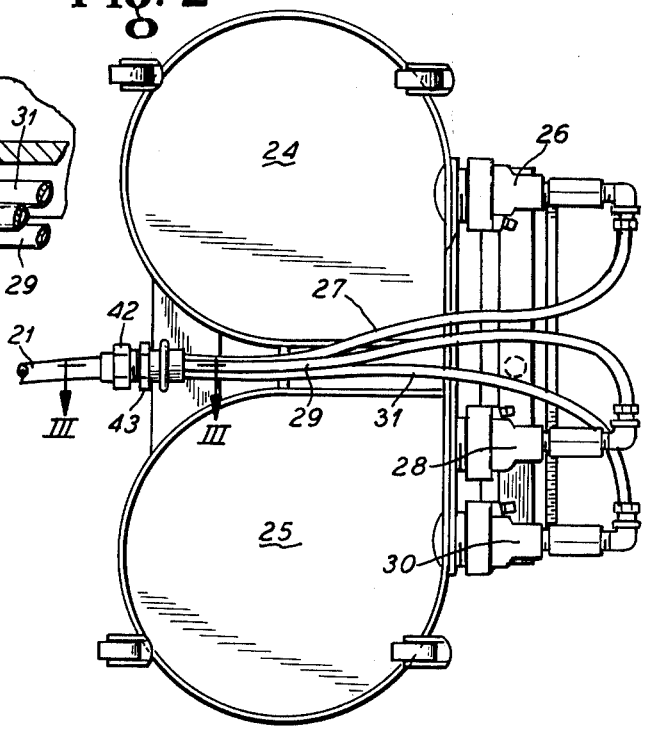
FIG. 2 is a partial plan view of the bottom of the containers illustrated in FIG. 1.
Figure 3:
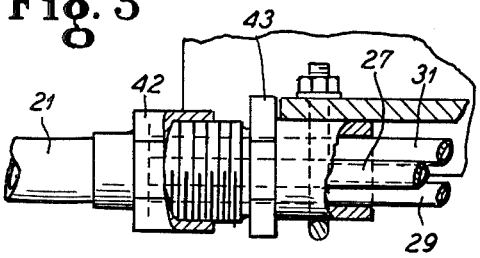
FIG. 3 is a partial cross-sectional view with portions in elevation for purposes of illustration taken along lines III—III of FIG. 2.

The device 15 as best illustrated in FIG. 2 includes a first container 24 and a second container 25. Each of the containers has means for supplying its contents under pressure. As illustrated, the device 15 utilizes grease gun pumps with the container 24 having a single pump element 26 discharging through a check valve into a discharge tube 27 and the container 25 having two pump elements 28 discharging through a check valve into tube 29 and the pump 30 discharging through a check valve into discharge tube 31. As illustrated, each of the pumps 26, 28 and 30 have the piston such as the piston 32 of the pump 26 (FIG. 1) connected to a common member 33 which is reciprocated in the vertical position by a shaft 34, which is guided in a bracket 35. To reciprocate the shaft 34, an appropriate linkage 36 connects the shaft 34 to a crank 37 mounted on an electric motor 38 which is supported on device 15 by a bracket 39. Thus, each of the grease gun pumps 26, 28 and 30 is reciprocated at the same time by the motor 38 which forms part of the means for reciprocating the pump elements and each pump discharges a fixed amount of material under pressure. It should also be pointed out that each of the containers are provided with a lid such as the lid 40 on the container 24 and the contents of each of the containers supports a follower disk, if needed, shown in broken lines such as the follower disk 41 in the container 24.

To connect the mixing tube 21 to the three discharge tubes 27, 29 and 31, an input end of the tube 21 has a coupling 42 which is connected to coupling means 43. The coupling means 43 sealingly receives each of the tubes 27, 29 and 31 with the tubes being arranged around the axis of the coupling 43. Thus, the coupling 42 when threaded on the threaded portion of the coupling 43 connects the mixing tube 21 to the discharge tubes 27, 29 and 31 to receive the material flowing therethrough.

Figure 4:
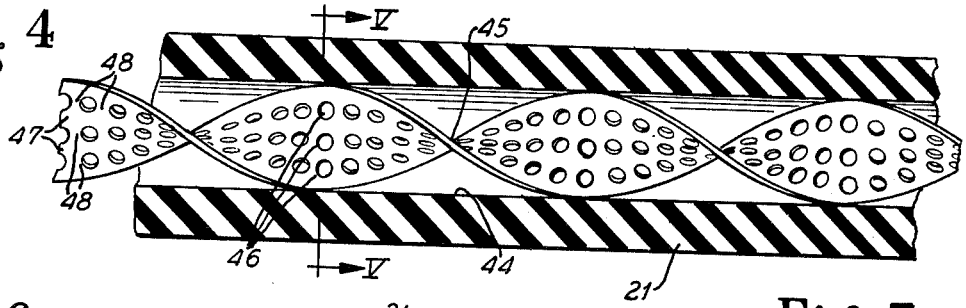
FIG. 4 is a longitudinal cross-sectional view with portions in elevation of a helically twisted strip member in accordance with one embodiment of the present invention.

The mixing tube 21 is made of a flexible material such as rubber reinforced with metal fabric so that the tube can withstand pressures up to 8000 psi. The tube 21 is a commercially available tube and has an internal surface 44 which receives a mixing element which extends from the input end such as illustrated by the coupling 42 to the discharge end which is attached to the tee 19. As best illustrated in FIG. 4, one embodiment of the mixing element comprises a helically twisted strip member 45. As illustrated, the strip member 45 has three separate rows 46 of apertures or perforations which extend along the length of the strip. As a result of each row 46 of apertures, the twisted strip member 45 has four helically extending elements 47, which extend between adjacent rows 46 of perforations with adjacent elements 47 being spaced apart by the perforations of a row and interconnection by bar material 48 which extends between adjacent perforations of each row.

Figure 6:
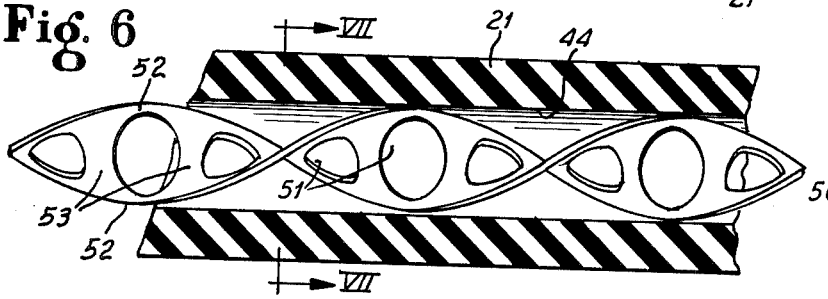
FIG. 6 is a partial longitudinal cross-sectional view with portions in elevation of a modification of a helically twisted strip member.
Figure 7:
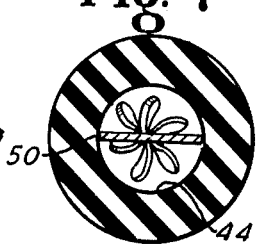
FIG. 7 is a cross-sectional view taken along lines VII—VII of FIG. 6.

A modification of the helically twisted strip member is illustrated in FIGS. 6 and 7 and is strip member 50. The member 50 has a single row of large perforations 51 which row forms two helically twisted elements 52, 52 which are spaced apart by the row of perforations 51 and interconnected by the bar material 53 which extends between adjacent perforations 51 of the row.

Figure 5:
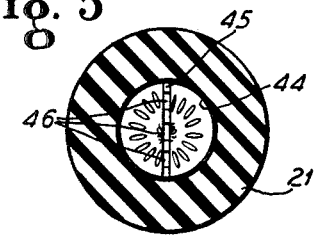
FIG. 5 is a cross-sectional view taken along lines V—V of FIG. 4.
Figure 8:
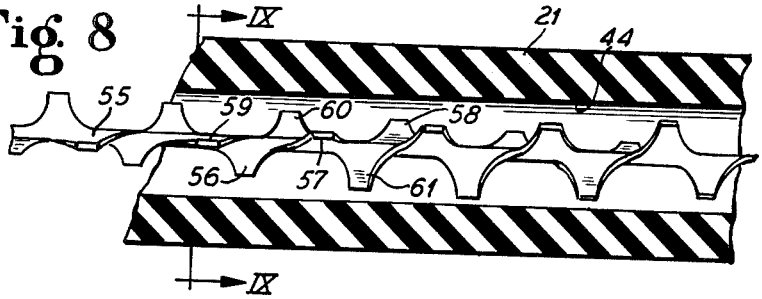
FIG. 8 is a partial longitudinal cross section with portions in elevation of a second modification of the helically twisted strip member.
Figure 9:
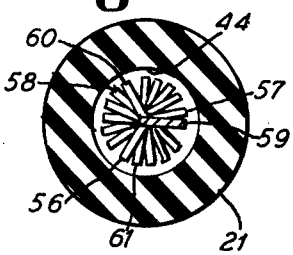
FIG. 9 is a cross section taken along lines IX—IX of FIG. 8.

Another modification of the helically twisted strip member is illustrated in FIG. 8 and 9 and comprises a strip member 55 which has projections such as 56, 57 and 58 extending from one edge and projections 59, 50 and 61 extending from the opposite edge. Through the twisting of the member 55, adjacent projections extend from the center of the twisted member 55 in different directions with the angle between adjacent projections on one side such as 60 and 61 forming an angle of less than 180°. As illustrated, the twist of the member 55 is such that the three projections such as 56, 57 and 58 extend at a direction of approximately 120° from the adjacent projection of their side although the angle is sufficiently different so that an end view (FIG. 9) of the element 55 has each of the three fingers being slightly offset to provide a radial spoke-like configuration. It also should be noted that the projections such as 59, 60 and 61 are slightly offset from the projections 56, 57 and 58 so that the projection 60 lies between the projections 56 and 57. As illustrated, the end of the projections such as 56 through 61 are spaced from the interior wall 44 of the flexible tube 21. In the previous embodiments illustrated in FIGS. 4 and 6, the twisted member engages the interior wall 44 as best illustrated in FIGS. 5 and 7.

Figure 10:
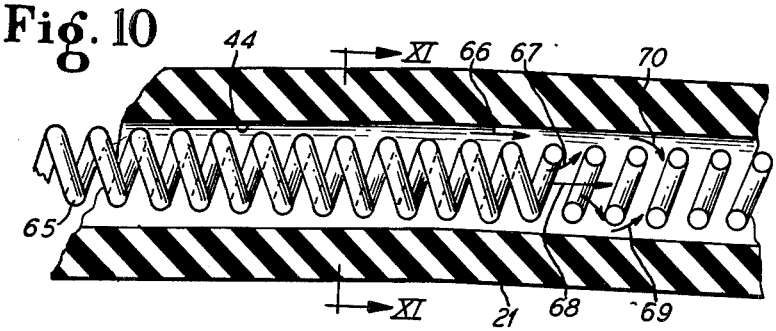
FIG. 10 is a partial cross-sectional view with portions in elevation for purposes of illustrated of an embodiment using a helical coil of wire.
Figure 11:
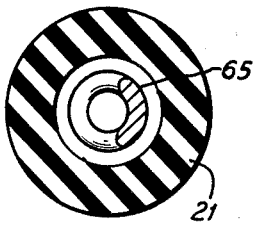
FIG. 11 is a cross section taken along lines XI—XI of FIG. 10.

An embodiment of the mixing element is illustrated in FIGS. 10 and 11 and is identified as a helical coil 65 of wire. The coil 65 is illustrated as having a substantially constant outer diameter which is less than the inner diameter of the inner surface 44 of the mixing tube 21. Thus, the material passing along the mixing tube can pass between the inner surface 44 and the wire forming the coil 65 as indicated by the arrow 66 as well as along and through or between the turns of the coil 65 as illustrated by the arrows 67, 68, 69 and 70. Due to the flow both between the coil 65 and the inner surface 44 as well as through and between the various turns of the coil 65, a good and rapid mixing of the constituents is obtained. In actual tests, it has been found that when the outside diameter of the coil 65 is approximately $\frac{1}{8}$ of an inch smaller than the diameter of the internal surface 44, a spacing of approximately 1/16 of an inch occurs between the wire forming the coil 65 and the inner surface 44. By controlling the inner diameter of the coil 65 so that the inner diameter is approximately 5/64 of an inch and the spacing between adjacent turns is such that there is approximately $\frac{1}{8}$ of an inch spacing therebetween, a good dividing and recombination of the various constituents occurs so that a good mixing is achieved. The tube 21 has a length of between 3 and $4\frac{1}{2}$ feet and has an internal diameter of between $\frac{1}{4}$ and $\frac{3}{8}$ inches. The tube length will vary somewhat depending upon the configuration of the mixing element as some designs work slightly better than others. The wire diameter of the coil 65 is selected so that desired $\frac{1}{8}$ inch difference between the internal diameter of the tube 21 and the outer diameter of the coil 65 exists and the coil 65 has approximately a 5/64 inch internal diameter. The above dimensions were with regard to the epoxy resin which was tested in the device. These resins have a viscosity of between 13000–16000 centipoise and when mixed together are thoxotropic and will flow only when placed under pressure. Because the epoxy is used to mend cracks and it is undesirable to have the epoxy flow out of the crack after being injected into the crack, this characteristic is very desirable.

Figure 12:
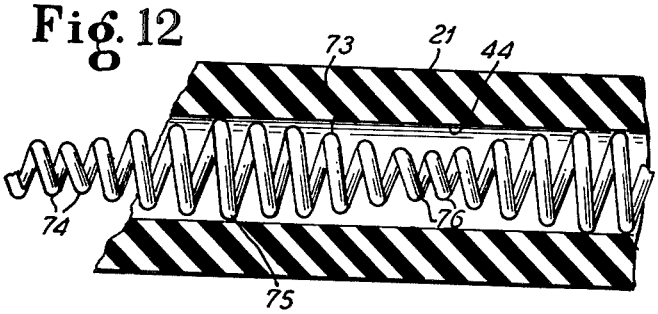
FIG. 12 is a partial longitudinal cross-sectional view with portions in elevation illustrating one modification of the helical coil of wire as the mixing element.

An embodiment of the helical coil 73 is illustrated in FIG. 12. In this embodiment, the outer diameter of the coil is constantly changing with the degree of change being gradual. For example, as viewed in FIG. 12, the diameter increases from a minimum diameter at the turns 74 to a maximum diameter at the turn 75 and then decreases gradually back to a minimum diameter at the turns 76.

Figure 13:
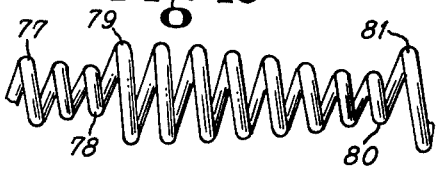
FIG. 13 is an elevational view of a second modification of the helical coil of wire as the mixing element.

A modification of the changing diameter of the coil 73 is illustrated by the coil 77 in FIG. 13. From a minimum diameter at turn 78 the diameter of coil 77 increases abruptly to a maximum diameter illustrated by the adjacent turn 79 then gradually decreases back to a minimum diameter such as illustrated by turn 80 where the diameter abruptly changes to a maximum diameter of the turn 81.

Figure 14:
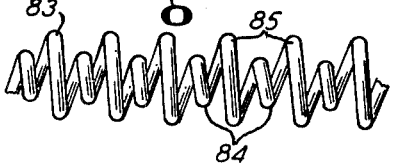
FIG. 14 is a third modification of the helical coil of wire as the mixing element.

Another modification of the helical coil is illustrated in FIG. 14 by the coil 83 which has adjacent turns of different diameters. For example, a small diameter turn 84 is interposed between two large diameter turns 85 so that alternate turns are of the same diameter.

Of each of the above mentioned coils 73, 77 and 83, the changing of the diameter facilitates the splitting up or dividing of the flow of the material in the mixing tube and its subsequent recombination to obtain a mixing thereof. While each of the elements of either the strips illustrated in FIGS. 4, 6 or 8 or the coils as illustrated in FIGS. 10, 12, 13 and 14 cause mixing of the constituents, the coaction of the mixing element with curves or bends in the flexible tube 21 such as illustrated in FIG. 1, increases the amount of mixing due to bending stresses changing the configuration of the passageway and the position of the mixing element therein. Thus, the flexible tube can change the amount of twist or pitch of the twist of the twist elements or change the position of the various turns of the coils. Thus, an improved mixing was found when the element, whether a coil such as 65 or a twisted strip such as 45 was utilized in the flexible tube 21. In addition, the flexible tube 21 enables the operator to freely move the nozzles 16 as desired without requiring the movement of the whole device 15.

Although various minor modifications may be suggested by those versed in the art, it should be understood that I wish to embody within the scope of the patent warranted hereon, all such modifications as reasonably and properly come within the scope of my contribution to the art.

I claim:

1. A portable device for mixing two materials in a desired proportion and dispensing the materials under pressure from a nozzle, said device comprising a separate container for each of said two materials; each of said containers having means for discharging the contents of the container under pressure from a discharge tube; a mixing tube of flexible material having a discharge end and an input end with a helical mixing element received in the mixing tube and extending between said ends, said element being a helically twisted strip member having projections extending from opposite edges thereof with the projections along one edge being offset from the projection along the other edge and with the twisting of said strip member causing the projections to extend outward from the axis of the member at different angles with two adjacent projections along one edge forming an angle of less than 180° and approximately 120°; a nozzle attached to the discharge end of the mixing tube; and coupling means attached to the input end for connecting the discharge tubes of the containers thereto so that a coaction of the mixing element and any bends of the flexible mixing tube provides a thorough mixing of the two materials as they pass along the tube prior to discharge from the nozzle.

2. A portable device for mixing two materials in a desired proportion and dispensing the materials under pressure from a nozzle, said device comprising a separate container for each of said two materials; each of said containers having means for discharging the contents of the container under pressure from a discharge tube; a mixing tube of flexible material having a discharge end and an input end with a helical mixing element received in the mixing tube and extending between said ends, said helical mixing element being a helical coil of wire, said helical coil being loosely received in the mixing tube; a nozzle attached to the discharge end of the mixing tube; and coupling means attached to the input end for connecting the discharge tubes of the containers thereto so that the material can flow between the wire of the helical coil and the interior wall of the mixing tube as well as between adjacent turns of the helical coil of wire and a coaction of the mixing element and any bends of the flexible mixing tube provides a thorough mixing of the two materials as they pass along the tube prior to discharge from the nozzle.

3. A portable device according to claim 2, wherein the diameter of the helical coil changes along the length of the coil.

4. A portable device according to claim 3, wherein adjacent turns of the helical coil have a different diameter so that a small diameter turn is disposed between two large diameter turns.

5. A portable device according to claim 3, wherein the change in the diameter of the helical coil is gradual so that the diameter of the helical coil gradually decreases from a maximum to a minimum diameter and then gradually increases to a maximum diameter.

6. A portable device according to claim 3, wherein change of the diameter between a maximum diameter and a minimum diameter is gradual and the change between the minimum and maximum is an abrupt change so that the helical coil has a profile of gradually decreasing to a minimum diameter, abruptly increasing to a maximum diameter and then gradually decreasing to a minimum diameter.

7. A portable device according to claim 2, wherein the diameter of the helical coil remains substantially constant with the spacing between adjacent turns of the coil being substantially in the same order of magnitude as the difference in the diameter of the outer helical coil relative to the internal diameter of the mixing tube.

8. A portable device for mixing two materials in a desired proportion and dispensing the material under pressure from a nozzle, said device comprising a separate container for each of said two materials; each of said containers having means for discharging the contents of the container under pressure from a discharge tube, said means for discharging including pumps with one of said containers having two pumps so that the amount of material discharged therefrom is approximately twice the amount of discharge from the other container; a mixing tube of flexible material having a discharge end and an input end with a helical mixing element received in the mixing tube and extending between said ends; a nozzle attached to the discharge end of the mixing tube; and coupling means attached to the input end for connecting the discharge tubes of the containers thereto, said coupling means including a fitting with the three discharge tubes spaced circumferentially around the axis of the fitting so that a coaction of the mixing element and any bends of the flexible mixing tube provides a thorough mixing of the two materials as they pass along the tube prior to discharge from the nozzle.

9. A portable device according to claim 8, wherein the mixing element is a helically twisted strip member.

10. A portable device according to claim 8, wherein the mixing element is a helically twisted strip member having at least one row of perforations extending therealong.

* * * * *